US005167768A

United States Patent [19]

Cronin et al.

[11] Patent Number: 5,167,768

[45] Date of Patent: Dec. 1, 1992

[54] WIDE NIP WEB PRESS AND METHOD USING A PRESS SHOE WITH TWO PIVOTS

[75] Inventors: Dennis C. Cronin, Rockton, Ill.; Arnold J. Roerig, Beloit, Wis.

[73] Assignee: Beloit Corporation, Beloit, Wis.

[21] Appl. No.: 790,279

[22] Filed: Nov. 7, 1991

[51] Int. Cl.[5] ..... D21F 3/06

[52] U.S. Cl. ..... 162/205; 162/358.3

[58] Field of Search ..... 162/205, 358, 360.1, 162/361; 100/118, 153, 154

[56] References Cited

U.S. PATENT DOCUMENTS

| | | | |
|---|---|---|---|
| 3,974,026 | 8/1976 | Emson et al. | 162/358 |
| 4,328,744 | 5/1982 | Pav et al. | 100/162 |
| 4,568,423 | 2/1986 | Laapotti | 162/358 |
| 4,581,797 | 4/1986 | Lehmann | 29/116 |
| 4,713,147 | 12/1987 | Saarinen | 162/358 |
| 4,917,768 | 4/1990 | Ilmarinen | 162/358 |
| 4,973,384 | 11/1990 | Crouse et al. | 162/358 |

FOREIGN PATENT DOCUMENTS

| | | | |
|---|---|---|---|
| 218918 | 2/1985 | German Democratic Rep. | 162/358 |
| 929773 | 5/1982 | U.S.S.R. | 162/358 |

*Primary Examiner*—Karen M. Hastings

*Attorney, Agent, or Firm*—Dirk J. Veneman; Raymond W. Campbell; Gerald A. Mathews

[57] ABSTRACT

A wide area type of wet press for dewatering an endless traveling web, such as paper, wherein a shoe having a curved face is applied to a traveling belt which travels through a high pressure zone between the shoe and a rotating backing roll. The nip line of the most intense nip pressure along the length of contact of the shoe over the backing roll is selectively located, as desired, by pivotally supporting the shoe about two, parallel, longitudinally extending axes which, in turn, are supported on separately controlled hydraulic pistons. The pressure profile of the nip pressure over the face of the shoe can also be altered by controlling the hydraulic pressure in the support pistons.

8 Claims, 5 Drawing Sheets

PRESSURE ON LARGE PISTON FOR DESIGNATED NIP LOADS

| PRESSURE ON SMALL PISTON (PSI) | 1000 | 2000 | 3000 | 4000 | 5000 | 6000 |
|---|---|---|---|---|---|---|
| 500 | | | 250. PSI | 417. PSI | 583. PSI | 750. PSI |
| 450 | | | 275. PSI | 442. PSI | 608. PSI | 775. PSI |
| 400 | | | 300. PSI | 467. PSI | 633. PSI | 800. PSI |
| 350 | | | 325. PSI | 492. PSI | 658. PSI | 825. PSI |
| 300 | | 167. PSI MAX | 350. PSI | 517. PSI | 683. PSI | 850. PSI |
| 250 | | 183. PSI | 375. PSI | 542. PSI | 708. PSI | 875. PSI |
| 200 | | 208. PSI | 400. PSI | 567. PSI | 733. PSI | 900. PSI |
| 150 | | 233. PSI | 425. PSI | 592. PSI | 758. PSI | 925. PSI |
| 100 | 83. PSI MAX | 258. PSI | 450. PSI | 617. PSI | 783. PSI | 950. PSI |
| 50 | 92. PSI | 283. PSI | 475. PSI | 642. PSI | 808. PSI | 975. PSI |
| 0 | 117. PSI | 308. PSI | 500. PSI | 667. PSI | 833. PSI | 1000. PSI |
| | 142. PSI | 333. PSI | | | | |
| | 167. PSI | | | | | |

NIP LOAD (PLI)

Fig. 5

WIDE NIP WEB PRESS AND METHOD USING A PRESS SHOE WITH TWO PIVOTS

BACKGROUND OF THE INVENTION

1. Field of the Invention

This invention relates to a papermaking machine press. More particularly, this invention relates to a papermaking machine press having a wide area of pressing contact. Still more particularly, this invention relates to a papermaking machine press having a wide area of pressing contact wherein the profile of the nip load, extending in the machine direction, can be selectively controlled. Even still more particularly, this invention relates to a wide area, or extended nip, type of papermaking machine press which utilizes a shoe which is pivotally mounted about two, parallel axes.

2. Description of the Prior Art

A typical example of the best prior configuration of a so-called extended nip type of papermaking machine press includes a backing roll having a smooth, continuous support surface and a shoe having a curved, convave face surface. The radius of curvature of the shoe is slightly larger than the radius of curvature of the backing roll surface. The paper web to be dewatered is passed through the wide, or extended, nip between the shoe surface and the backing roll with at least one felt on one side of the web and, usually, a second felt on the other side of the web. Intermediate the surface of the shoe and any felt on the shoe side of the paper web, or the paper web in the case where there is no felt on the paper web side of the shoe, is a belt which presents a co-traveling first surface with the felt, or web, and a second surface which engages the shoe in sliding contact.

The shoe is hydraulically actuated to provide pressure over a wide area between the shoe, the belt and paper web traveling over the backing roll surface. In order to attain a condition of equilibrium between the surface of the pressure shoe against the dynamic forces of the belt, felt(s) and web over the surface of the backing roll, the pressure shoe is pivoted about a cylindrical rod, such as shown and described in U. S. Pat. No. 4,425,190 (Cronin), which co-extends parallel with the rotational axis of the backing roll longitudinally in the cross-machine direction. This allows the shoe to come into an equilibrium condition wherein the hydrodynamic forces acting on the paper web, felts and belt, including any lubricant passing through the nip between the belt and shoe, are balanced about the cylindrical rod supporting the pressure shoe.

Such an arrangement operates well and provides paper web dewatering over a wide area pressing zone which substantially exceeds the narrow contact area to which the paper web is exposed in an ordinary nip between co-rotating opposed rolls in a press couple in a papermaking machine. However, it is desired that the water removal process in the pressing operation of a papermaking machine should be optimized, in conjunction with optimized paper formation, to obtain a finished paper product having superior qualities, and combinations of qualities, relating to such parameters as, for example, burst strength, tensile strength, texture, surface smoothness, fiber distribution and bulk. Such optimization is a function of machine speed, nip load, and the pressure profile, all in conjunction with the grade of paper being produced.

Prior shoe-types of extended nip presses have limited operational flexibility due to the rigid geometry of the shoe and its range of movement, or adjustability, relative to the backing roll when in operation. Since the shoe has a single pivot, once the papermaking machine reaches a given speed, the hydrodynamic forces acting on the shoe locate it in a position relative to the backing roll which is determined by these forces. This position, in turn, determines the dewatering pressure profile acting on the paper web. The shoe is maintained in this position until some combination of the machine speed or nip loading force against the shoe over the backing roll changes. At a certain machine speed, at a certain nip load, the pressure profile will be optimal, or nearly optimal, for producing a certain grade of paper. However, either increasing the machine speed, or increasing the total nip load, or some combination of both, does not result in a pressure profile which necessarily remains optimal for the grade of paper being produced. Further, there is nothing which can be done to remedy the non-optimal pressure profile when the machine speed and/or nip loading changes since the shoe is positioned solely by the hydrodynamic forces of the machine components passing through the extended nip while the shoe remains on its fixed pivot.

Some shoe-type extended nip presses have been made wherein the shoe has a plurality of parallel grooves extending longitudinally such that the shoe can be pivotally mounted over a pivot rod which can be positioned in a selected one of such grooves. Such a configuration is shown and described in U.S. Pat. No. 4,973,384 (Cronin). This allows the pressure profile in the extended nip to be changed, but to change the location of the pivot rod in a selected groove of the shoe requires that the papermaking machine be shut down for a considerable period of time to effect this change. This not only is costly, due to lost production time, but the pressure profile for each groove is also fixed so that operation of the extended nip press is only optimal for a given grade of paper for a certain combination of machine speed and nip load within a relatively narrow range regardless of which pivot groove is selected.

As a result of these facts relating to the physics involved in the operation of such a wide area, extended nip type of papermaking press having a pressure profile, each such press essentially has to be designed to manufacture a specific paper product at a specific nip pressure at a specific operating speed, all within a relatively narrow range of the parameters involved.

SUMMARY OF THE INVENTION

The problems and deficiencies associated with prior wide or extended nip type of papermaking machine presses have been obviated by this invention. The pressure shoe is pivotally supported on two, parallel rods, each of which is pressurably supported by a separate piston. The pistons, which can comprise one or more piston members aligned longitudinally beneath corresponding support rods, operate to apply different forces to the pivot rods to bias the face of the pressure shoe with different forces.

The longitudinal axes of the cylindrical rods supporting the pressure shoe are arrayed with the axis of one rod located downstream, in the direction of paper web travel, of a plane extending along the axis of rotation of the backing roll and, in the preferred embodiment, the longitudinal axis of the other rod supporting the pressure shoe. In the operation of a wide area type of press utilizing a pressure shoe pivoted on a single support rod located in a plane through the axis of the backing roll, or downstream therefrom, the application of lubricant to the interface between the traveling belt and the stationary support shoe surface creates a hydrodynamic condition wherein the pressure forces near the upstream surface of the pressure shoe are substantially less than the ultimate pressure forces near, and over, the sole cylindrical pivot rod.

In the apparatus of this invention, by being able to apply force to the trailing side of the pressure shoe, the location of the effective nip load resultant force can have its imaginary nip line shifted from where it would be if the pressure shoe were supported solely over a single pivot. This permits the pressure profile within the total pressure zone to be altered so as to decrease the maximum pressure force on the upstream surface portion and increase the pressure force in the downstream surface portion of the pressure zone. Such a controlled variation of the dewatering pressure within the pressure zone allows the more controlled application of pressure, either more or less, to the paper web before the web reaches the location of the maximum nip pressure and, therefore, the paper web can be in a more dewatered condition before reaching the point of maximum nip pressure. Such control is achieved independently of the maximum nip load, machine speed, or paper grade. The paper web is, therefore, able to withstand the maximum nip pressure force at a predetermined nip load without being subjected to the phenomenon of fiber crushing which occurs when too much water remains in the web at a nip load which will cause such fiber crushing.

By altering the pressure zone before the location of the maximum nip pressure, the papermaker establishes a variable, more gentle pressure profile, which provides more latitude in operating the papermaking machine at greater speed while pressing the moist paper web as efficiently and effectively as the web could be pressed at lower speeds in prior types of single pivot shoe extended nip presses.

The use of a double pivot arrangement supporting the pressure shoe permits both the location of the resultant force within the pressure zone in an extended nip type of press to be shifted and the pressure profile to be altered while utilizing the same pressure shoe. It also allows the hydrodynamic pressure and forces associated with the wide area press to be shifted and controlled along the pressure profile in the machine direction. Specifically, the double pivot arrangement permits the location of the maximum nip pressure to be shifted rearwardly along the face of the shoe to enhance resistance to rewetting of the web after it passes from the extended nip.

Accordingly, it is an object of this invention to provide a shoe-type of wide area press for a papermaking machine having a shoe which remains stable under all operating conditions.

Another object of this invention is to provide a shoe-type of wide area papermaking press wherein the location of the resultant nip load can be shifted.

An object, feature and advantage of this invention is the provision of a shoe-type wide area papermaking machine press wherein the profile of the pressure zone can be selectively varied.

Another object, feature and advantage of this invention is to provide a shoe-type of wide area papermaking machine press wherein the location of the maximum nip pressure can be shifted within the pressure zone of the shoe.

A feature and advantage of the invention is the provision of a single shoe in a wide area type of papermaking machine press wherein the shoe is supported by two, parallel rods.

A feature and advantage of the invention is the provision of a single shoe in a wide area type of papermaking machine press wherein the shoe is actuated by two, separate pressure pistons.

Another feature and advantage of the invention is the provision of a shoe-type of wide area papermaking machine press which includes a backing roll wherein the support of the shoe is not solely along a plane through the backing roll axis of rotation and a pivot of the shoe.

These, and other objects, features and advantages of this invention will be more readily apparent to those skilled in the art when the following description of the preferred embodiment is read in conjunction with the attached drawings.

BRIEF DESCRIPTION OF THE DRAWINGS

FIG. 5 is a chart showing the relationship between the hydraulic pressures in the primary and secondary support pistons to achieve a selected nip load.

DESCRIPTION OF THE PREFERRED EMBODIMENT

Figure 1:
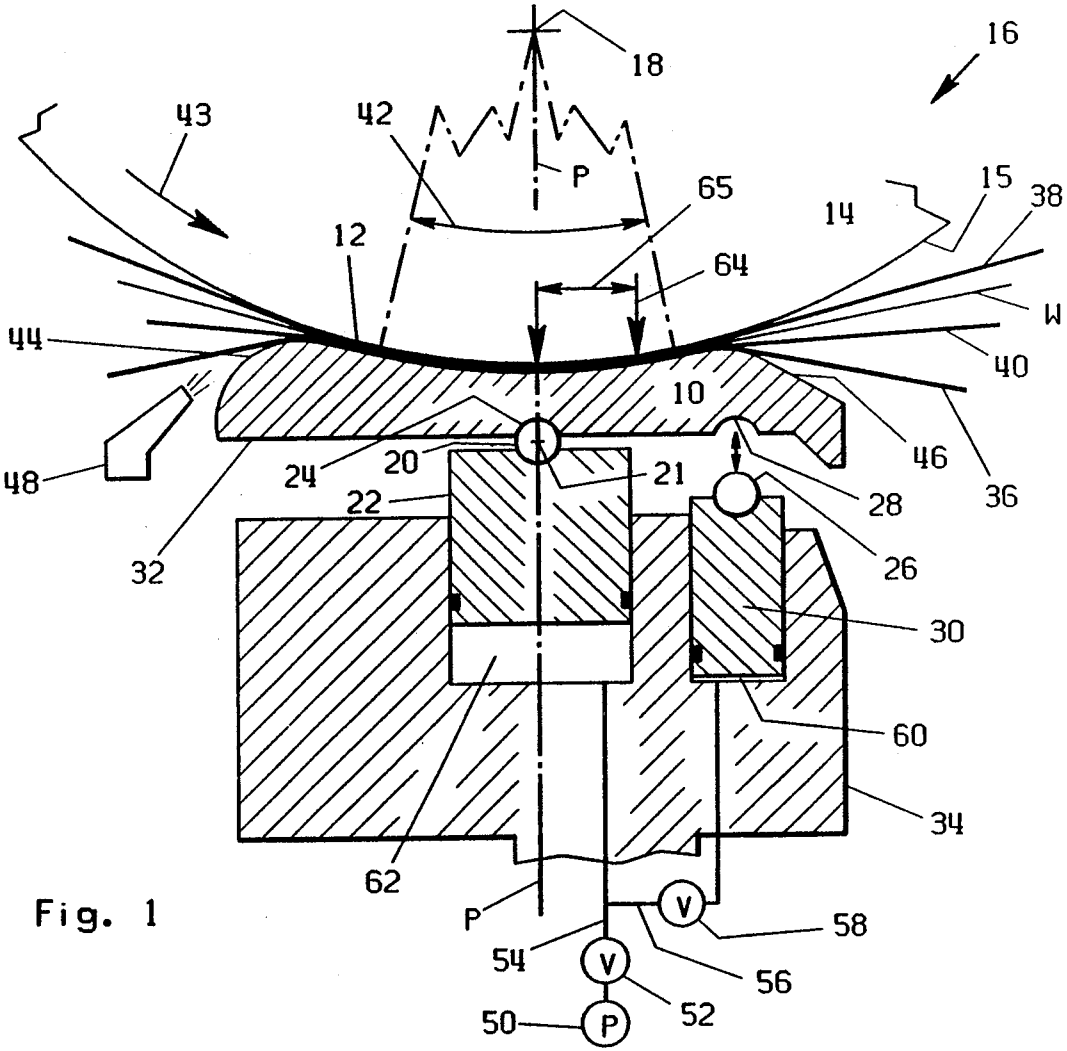
FIG. 1 is a cross-sectional elevation view, somewhat in schematic form, of a wide area, or long-nip, or extended nip type of papermaking machine press showing a shoe pivotally supported by two separate pistons.

With reference to FIG. 1, a shoe 10 for a wide area nip, sometimes referred to as an extended nip, type of papermaking machine press has a concave face 12 which is juxtaposed over the cylindrical surface of a backing roll 14. The wide area nip is generally referenced by numeral 16. The backing roll 14 is shown partially broken away, but it is rotatably mounted to rotate about journals (not shown) which are concentric with its longitudinal axis 18. The shoe 10 is pivotally supported about a primary pivot rod 20 which, in turn, is mounted with one side supported on a primary support piston 22. The other side of the primary pivot rod is supported in a semi-circular groove 24 in the shoe.

Downstream of the primary pivot rod 20 is a secondary pivot rod 26 which, in turn, has one side which pivotally mounts into a semi-circular groove 28 in the shoe. The other side of the secondary pivot rod is supported on the secondary support piston 30. The grooves 24,28 are parallel and extend longitudinally along the length of the underside surface 32 of the shoe. Thus, when the shoe is mounted in operating position in the press section of a papermaking machine, grooves 24,28 extend in the cross-machine direction and parallel with the axis of rotation 18 of the backing roll.

Figure 2:
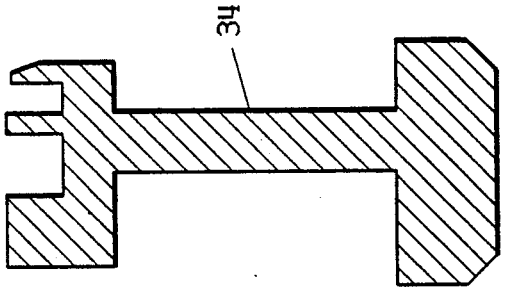
FIG. 2 is a cross-sectional view of the beam on which the pistons are mounted.

The primary and secondary support pistons 22,30 are mounted in a beam 34, shown in FIG. 2, to bring their pivot rods into supporting and actuating engagement with the shoe 10.

Intermediate the concave face surface 12 of the shoe and the cylindrical surface 15 of the backing roll is a belt 36, a first felt 38, a paper web W and a second felt 40. The concave surface of the shoe is preferably made with a cylindrical radius of curvature which is slightly larger than the radius of curvature of backing roll 14. When the shoe is loaded by the primary and secondary support pistons 22,30 into engagement with the belt, first and second felts and the paper web over the surface of the backing roll, an arcuate pressure zone designated by the double headed arrow 42 is created which represents the extension in the machine direction of the wide area, or extended, nip of the press. The length of such an arcuate pressure zone, in the direction of machine travel, shown by arrow 43, is approximately 10 inches in the exemplary embodiment being discussed.

The leading and trailing ends 44,46, respectively, of the shoe are rounded to accommodate the convergence of the belt, felts and paper web over the leading edge of the shoe, and the divergence of these components from the trailing edge of the shoe. On the leading side of the press, a nozzle 48 sprays lubricant, such as oil, into the interface between the traveling belt 36 and the leading edge 44 of the shoe to provide lubrication between the sliding surface of the belt against the stationary surface of the shoe. The array of the belt, felts and web over the shoe, and the manner of lubrication of the belt over the shoe, are well-known in the papermaking industry and will not be discussed further.

As shown in FIG. 1, a plane P passes through the longitudinal axis of rotation 18 of the backing roll 14 and the longitudinal axis 21 of the primary pivot rod 20 which is supported in the grooves of the shoe and the primary piston, respectively.

Primary piston 22 in this embodiment is selected to be 6 inches in width, while the secondary piston 30 is selected to be 3 inches in width. A pump 50 supplies pressurized hydraulic fluid through a valve 52 into a downstream line 54 from which a secondary hydraulic line 56 leads into a valve 58 and then into the piston chamber 60 for the secondary piston 30. Similarly, the hydraulic line 54 leads into the piston chamber 62 for the primary piston 22.

Both the primary and secondary pistons can be embodied in either a plurality of aligned cylindrical pistons extending along the length of the beam 34, or they can comprise a single rectilinear member which extends continuously within the beam for substantially the length, in the cross-machine direction, of the extended nip. In either event, the cross-sectional configuration of the beam, as shown in FIG. 2, is designed to have the neutral axis of the beam between the nip load force design limits exerted by the primary and secondary pistons.

Figures 3A, 3B, 3C, 3D, 3E:
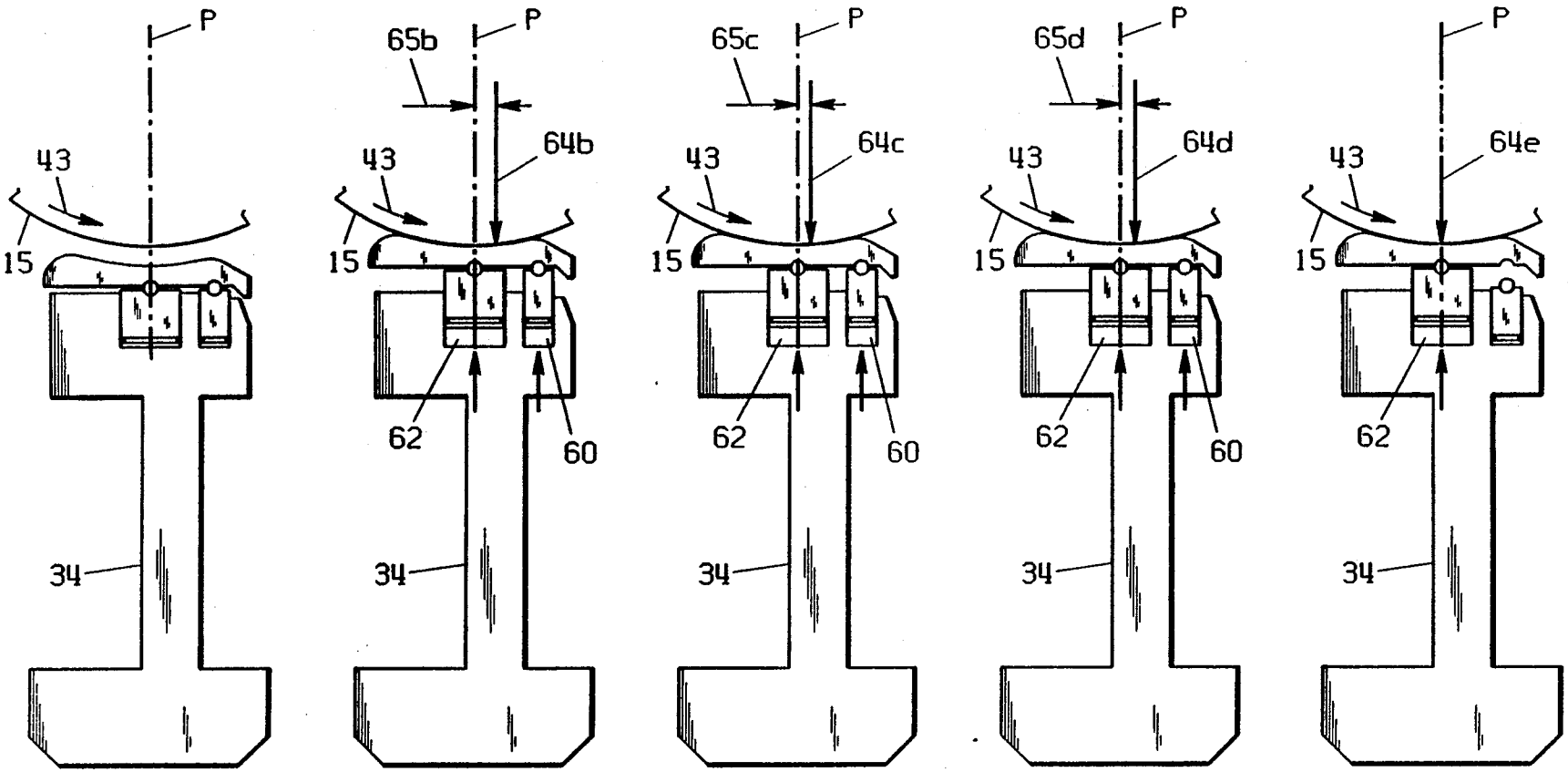
FIGS. 3A, 3B, 3C, 3D and 3E are end views of the shoe in various loading conditions by the pressure pistons mounted on the beam which illustrate the selective movement of the location of the effective resultant nip load force on the shoe.

Referring to FIG. 3, the operation of the primary and secondary pistons to shift the location of the effective resultant nip load force along the face of the shoe, in the machine direction of travel 43 is illustrated by example. Thus, in FIG. 3A, both pistons are in a non-actuated state and the shoe is not engaged with the backing roll. In all of the illustrations in FIGS. 3A–3E, the belt, both felts and paper web have been omitted for clarity. In FIG. 3B, both the primary and secondary pistons are actuated with the same hydraulic pressure, in this case 1,000 psi, for example, and the location of the resulting nip load force, in this case 9,000 pounds per lineal inch, is 2.17 inches downstream from the plane P. In FIG. 3C, the hydraulic pressure in the primary piston remains at 1,000 psi, but the hydraulic pressure in the secondary piston has been reduced by valve 58 to 500 psi. This results in the location of the resultant nip load force of 7,500 pli at 1.3 inches downstream of plane P. Thus, it can be seen that the application of different hydraulic pressures to the piston chambers beneath the primary and secondary pistons can result in both the change in the total resultant nip load force as well as the change in its location on the face of the shoe. Continuing with this illustrative example, in FIG. 3D, the hydraulic pressure against the primary piston is set at 769 psi, while the hydraulic pressure in the secondary piston chamber is set at 461 psi by operation of valves 52, 58, respectively. This results in the application of the effective resultant nip load force of 6,000 pli at a point on the shoe face 1.5 inches downstream of plane P. Finally, as illustrated in FIG. 3E, if a hydraulic pressure of 1,000 psi is applied to the chamber 62 beneath the primary piston, and no hydraulic pressure is applied to the chamber 60 beneath the secondary piston, the secondary piston rod 26 is withdrawn from supporting engagement with the shoe, and the resultant nip load force of 6,000 pli is applied to the shoe in the plane P.

The effective resultant nip load force is the force which will balance the sum of the hydraulic forces provided by the primary and secondary pistons 22, 30, respectively. The location of the effective resultant nip load force, which might be considered to be a vector 64, as shown in FIG. 1, for purposes of discussion, is the position between the primary and secondary pivot rods 20, 26, where the nip load force vector would balance the forces applied to the primary and secondary pivot rods in the opposite directions by the primary and secondary pistons 22, 30, respectively. The force vectors **64*b*, 64*c*, 64*d*, 64*e*, shown in FIGS. 3B–3E, are actually imaginary since the reaction force applied to the concave surface of the shoe by the backing roll is actually a distributed pressure force applied by the pressure of the wide area nip over the arcuate pressure zone 42, shown in FIG. 1, which is produced, at least in part, by the hydraulic pressure at the interface between the belt, felt(s) and web sandwiched between the backing roll and shoe. Essentially, the effective resultant nip load force vector, and its location, are mathematical tools which serve to help describe the phenomenon of the alteration of the pressure profile in the pressure zone, as will be explained in more detail below in conjunction with FIG. 7**.

Figure 4:
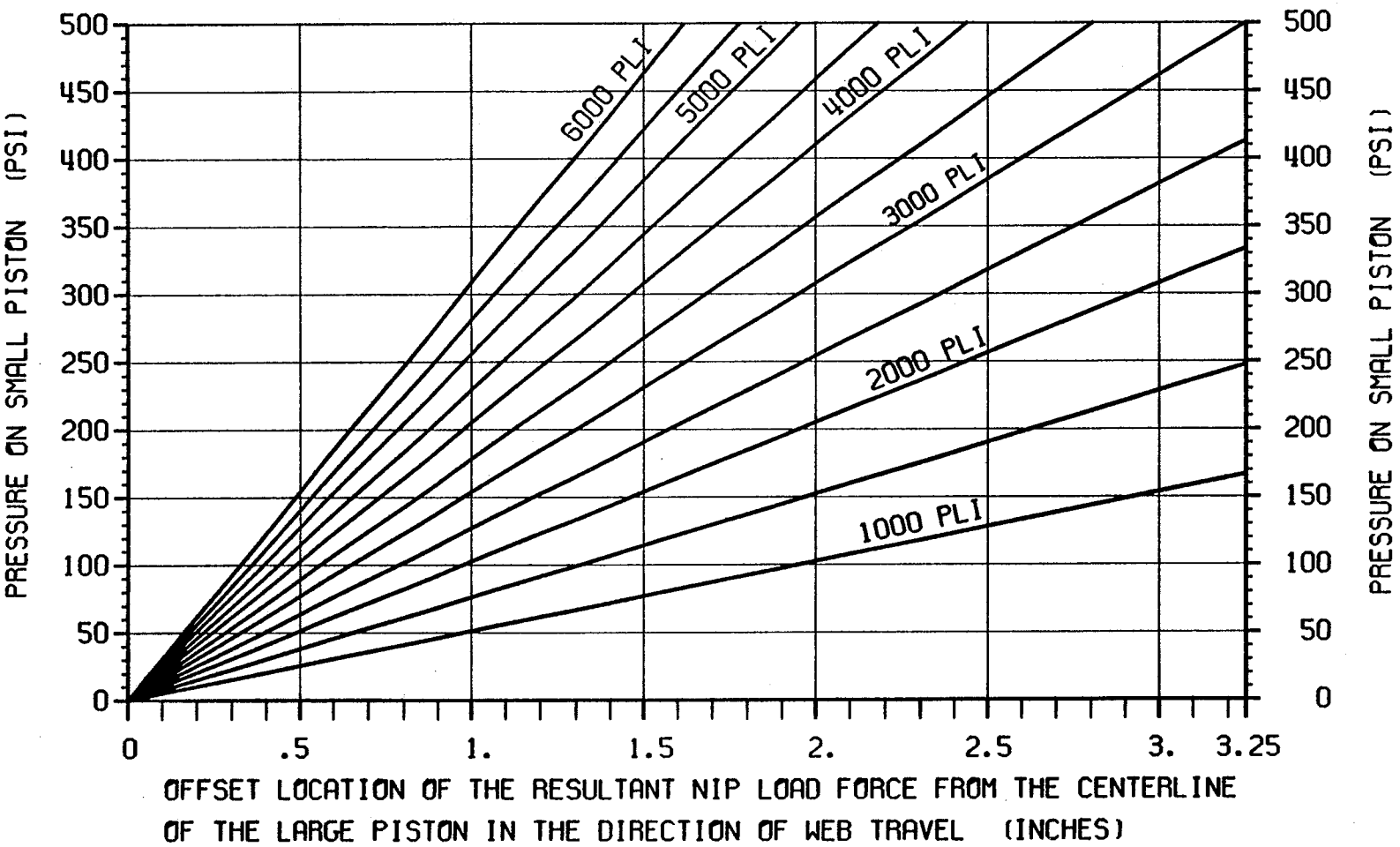
FIG. 4 is a graphical representation of how the hydraulic pressure in the downstream support piston, in a shoe supported by two pistons, can be varied to change the location of the resultant nip force relative to the primary piston.

With references to FIGS. 1, 4 and 5, the secondary piston 30 is smaller in size than the primary piston 22 due to the fact that it can utilize the leverage provided by the distance of the secondary pivot rod 26 downstream of the primary pivot rod 20 to pivot the shoe relative to the primary pivot rod against the backing roll surface. In conjunction with this description, the term nip load, or nip load force, refers to the pressure force exerted by the primary and secondary pistons through their corresponding pivot rods against the shoe and expressed in terms of pounds of force per lineal inch of cross-machine width (pli). Thus, by way of example, if the hydraulic pressure within the chamber 62 beneath the primary piston is 1,000 psi, and the area of the face of a rectangular piston 6 inches wide by 200 inches long is 1,200 in.$^2$, then the nip load force will be 1,200 in.$^2 \times$ 1,000 pounds/in.$^2$/200 in. nip face width = 6,000 pli (pounds per lineal inch). In other words, the nip load force is expressed in terms of pounds per lineal inch acting to actuate and load the shoe against the backing roll. Similar terminology is utilized with respect to the secondary piston and its nip loading force against the shoe through the secondary pivot rod.

When hydraulic pressure is applied to both the primary and secondary pistons, less pressure is required in the primary piston to produce a predetermined nip loading force, in pli, of the shoe against the belt, felts and web over the backing roll than would be required if the primary piston alone was used to provide the nip loading force. Further, at a given nip load force, in pli, smaller hydraulic pressures acting on the secondary piston will maintain the corresponding resultant nip load force at decreasing offsets from the plane P in the downstream direction as shown in FIG. 4. In other words, the effective resultant nip load force 64 is located at a specific offset from plane P depending on the hydraulic pressure applied to the secondary piston.

As mentioned above, and with reference to FIG. 5, when hydraulic pressure is applied to the secondary piston 30, the hydraulic pressure required in the primary piston 22 is less. Due to the geometry selected to size the primary and secondary pistons, in this case a primary piston having a 6 inch width and a secondary piston having a 3 inch width, it has been found that at a given hydraulic pressure applied to the small piston, half of that hydraulic pressure can be subtracted from the hydraulic pressure which would otherwise be applied solely to the primary piston to arrive at an actual, or revised, hydraulic pressure applied to the primary piston to effect and maintain a given nip load force. The hydraulic pressures selected for both the secondary and primary pistons is dependent on the desired nip loading force applied to the shoe through the primary and secondary pivot rods to produce the reaction effective resultant nip load force as shown by vectors 64*b*, 64*c*, 64*d*, 64*e*, in FIGS. 3B–3E, and their offsets 65*b*, 65*c*, 65*d*, respectively, downstream from plane P.

Thus, for example, with reference to FIGS. 4 and 5, if it is desired to have a nip load of 4,000 pli on the shoe (FIG. 5) at an offset of 2 inches downstream from plane P (FIG. 4), approximately 410 psi hydraulic pressure is required to be applied to the secondary piston 30 (FIG. 4). Referring to FIG. 5, at a nip load of 4,000 pli at a hydraulic pressure of 410 psi applied to the secondary piston, the hydraulic pressure required on the primary piston to maintain the 4,000 pli nip load is approximately 462 psi. Similarly, at an offset of 1 inch (FIG. 4), a hydraulic pressure of slightly over 200 psi applied to the secondary piston would maintain a nip load of 4,000 pli if a hydraulic pressure of slightly under 567 psi was applied to the primary piston.

What the graph in FIG. 4 and chart in FIG. 5 disclose is the relationship of the hydraulic pressures applied to the primary and secondary pistons to alter the pressure profile of the extended nip in the pressure zone 42 as shown in FIG. 1.

Figure 7:
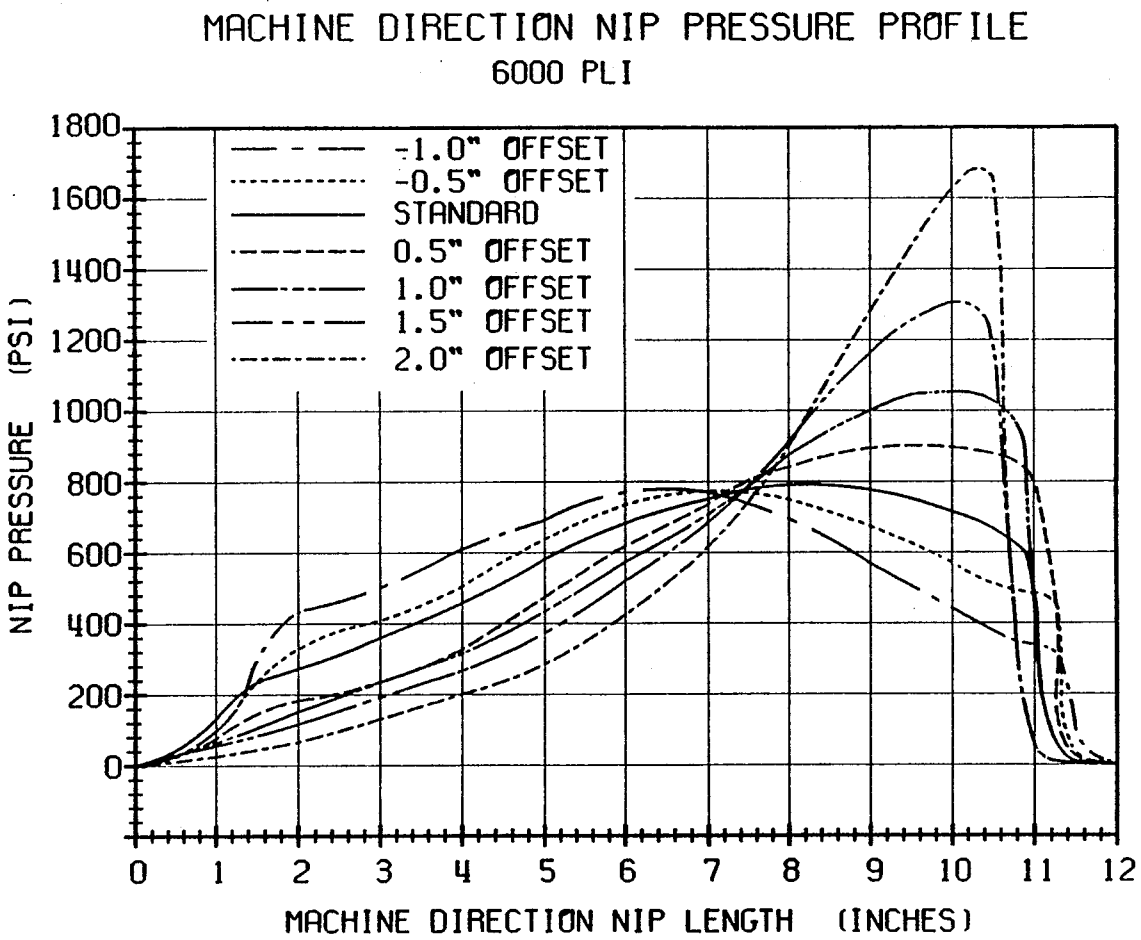
FIG. 7 is a chart of curves of the pressure profile on a shoe which is supported on a single pivot rod at different positions on the shoe, such as shown in FIG. 6.
Figure 6:
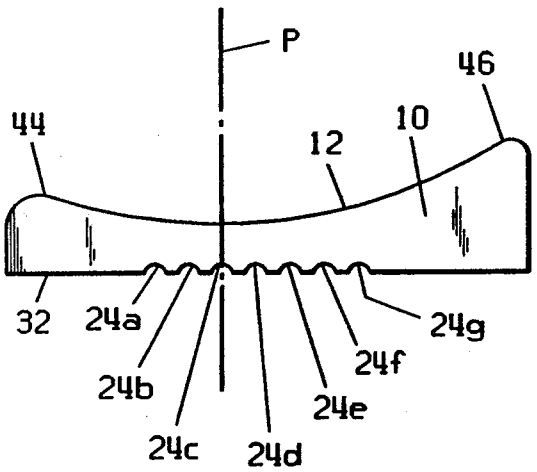
Fig. 6 (PRIOR ART)
FIG. 6 is an end view of a prior shoe configuration having a plurality of aligned grooves for supporting the shoe on a single pivot rod at different locations.

With reference to FIGS. 6 and 7, a shoe having a plurality of spaced, parallel grooves 24*a*, 24*b*, 24*c*, 24*d*, 24*e*, 24*f*, 24*g*, as shown in FIG. 6, was tested in an extended nip type of papermaking machine press at different distances of offset from a standard groove position 24*c*. The standard was no offset at all from a plane P which extended through the center of a pivot rod in groove 24*c* and the axis of rotation of a backing roll (not shown in FIG. 6) in a manner analogous to FIG. 1. The negative offsets were the grooves 24*a*, 24*b* to the left of the standard, or center, groove 24*c*, as shown in FIG. 6. The other offsets were to the right of the center groove 24*c*. With the shoe loaded through a single pivot rod in a specific groove/offset, the nip pressure in the pressure zone 42 was measured at different arcuate lengths along the pressure zone in the machine direction.

As can be seen, the different offsets produce curves having different pressure profiles. Comparing the extremes depicted by the curves for the minus 1.0 inch offset (groove 24*a*) and the 2.0 inch offset (groove 24*g*), it is seen that at an offset of minus 1.0 inch, which corresponds to pivoting about groove 24*a* in the shoe shown in FIG. 6, the nip pressure is relatively greater in the upstream portions of the pressure zone (FIG. 7). The maximum pressure also occurs at a relatively low level of slightly less than 800 psi and at a relatively upstream location along the pressure shoe of about 6.5 inches. Conversely, with regard to the pressure profile corresponding to the 2.0 inch offset (groove 24*g*), the nip pressure in the pressure zone rises slowly and at a low level for a considerable distance in the pressure zone. It does not reach the 800 psi nip pressure level until about 7.5 inches along the pressure zone. However, the nip pressure increases relatively rapidly from that point to a peak of about 1,700 psi at about 10.4 inches along the length of the pressure zone.

The pressure profile corresponding to the minus 1.0 inch offset is undesirable because the nip pressure decreases for a relatively long distance within the pressure zone before the paper web exits the extended nip press. This relatively long distance of decreasing pressure after reaching a peak pressure permits the web to be rewetted by water which has previously been expressed from the web into the felts. Such rewetting of the web is, of course, deleterious to the papermaking process and function of the press.

By contrast, in the profile corresponding to the 2.0 inch offset (groove 24*g* in the shoe shown in FIG. 6), there is very little rewetting of the web possible due to the rapid decrease in nip pressure over a relatively short distance in the pressure zone before the web exits the press. However, in the profile corresponding to the 2.0 inch offset, the peak nip pressure might be too high to avoid crushing at a desired papermaking machine speed. In addition, the relatively low profile for this offset in the first 6 inches, or so, of the pressure zone shows that the water removal process may be too slow to permit the machine speed to be increased.

A better compromise is illustrated by the pressure profile corresponding to the 1.0 inch offset wherein the nip pressure increases more rapidly compared with the nip pressure corresponding to the 2.0 inch offset, but it reaches a maximum of only about 1,100 psi from where it trails off relatively rapidly to also avoid rewetting.

The double pivoted arrangement of this invention permits the adjustment of the effective nip pressure in the pressure zone of an extended nip type press to essentially be infinitely adjustable so as to tailor the nip profile to any position within the extremes of the possible profile curves, such as shown in FIG. 7, for example.

In operation, a nip loading force is selected to be applied to the specific grade of paper to be made to effect the dewatering desired within the extended nip press. The location of the application of the effective resultant nip load force from the plane P, which resultant is shown as vector force 64 in FIG. 1 at an offset of 65, is determined. Hydraulic fluid is introduced into the piston chambers of the primary and secondary pistons under pressure provided by pump 50. The valves 52, 58 are adjusted so that at a hydraulic pressure to be applied to the secondary piston for the predetermined offset (FIG. 4), the nip load can be determined. Then, the actual hydraulic pressure needed to be applied to the primary piston can be determined from the chart in FIG. 5. Conversely, for a predetermined nip load at a given offset (FIG. 4), the hydraulic pressure required to be applied to the secondary piston can be determined. Then, using the chart shown in FIG. 5, the hydraulic pressure to be applied to the primary piston can be determined to maintain the desired nip load in pounds per lineal inch.

The primary and secondary pistons provide actuating and loading forces to the primary and secondary pivot rods which support the shoe for pivotal and translational movement into, and out of, nip pressure engagement with the belt over the backing roll. Differences in the hydraulic pressures applied to the primary and secondary pistons create different pressure profiles in the pressure zone.

Accordingly, using the family of parameters of nip load, hydraulic pressures in the secondary and primary piston chambers, and the location of the resultant nip load from the plane P, selected ones of these parameters can be used to determine the other parameters to produce the nip pressure profile desired. This permits the papermaker to vary the pressure profile in the pressure zone of an extended nip type of papermaking press to suit his needs to effectively and efficiently dewater the traveling paper web at predetermined speeds and nip pressures according to the grade of paper which is desired to be produced.

Naturally, variations in this invention will be readily apparent to those skilled in the art having read the above description of the preferred embodiment in conjunction with the attached figures. Such variations are intended to be within the scope of the invention as defined by the appended claims.

For example, the actuating means are described as hydraulic pistons 22, 30, but it is contemplated that the actuating means could comprise electrical actuators. Similarly, while the control means for controlling the pressure of the hydraulic fluid within the pistons 22, 30 is described as comprising valves 52, 58, it is contemplated that such control means could comprise electrical switches, or the like, for controlling either the voltage or current to any such electrical actuators to control the output force provided by such actuators. In a like manner, while the grooves are described as being semi-circular, and the support means is described as pivot rods 20, 26 disposed in such semi-circular grooves, it is contemplated that the pivots or grooves for cooperating in the support of the shoe on the actuating means could comprise one or more pivot notches with the support means comprising a corresponding pointed or edged element to fit into the notches.

What is claimed is:

1. In a wide area nip type of wet press for dewatering a traveling paper web in a papermaking machine, the press including a shoe, a rotatable backing roll having an axis of rotation, a looped belt and one or more looped felts for passing through the nip with the paper web, said one or more felts positioned for receiving water expressed from the web, the combination comprising:

the shoe comprises a single, unitary piece and has a concave face for urging the belt over the one or more felts and paper web against the surface of the backing roll to establish a pressure zone therebetween, and a shoe support surface having two pivots, one pivot being a primary pivot located in a radial plane extending through the backing roll axis of rotation, and the other pivot being downstream thereof in the direction of web travel;

said two pivots respectively comprising primary and secondary parallel grooves extending longitudinally in the shoe support surface, and primary and secondary pivot rods disposed in corresponding ones of the primary and secondary grooves in the shoe for providing pivotal movement of the shoe over the pivot rods;

support means for movably supporting the shoe against the belt about the two pivots on the shoe;

beam means;

actuating means structured and arranged for applying parallel actuation forces to the support means relative to the beam means through the two pivots respectively on the shoe to selectively effect pivotal movement of the shoe about a selected one, or both, of the pivots on the shoe, to selectively vary the pressure profile in the pressure zone.

2. A wide area nip type of wet press as set forth in claim 1, wherein:

the actuating means comprises separate hydraulic means, each such hydraulic means operatively connected to a separate pivot of the support means.

3. A wide area nip type of wet press as set forth in claim 2, further including:

valve means associated with each of the separate hydraulic means for controlling the application of the force to the shoe differently at each of the two pivots on the shoe.

4. A wide area nip type of wet press as set forth in claim 1, wherein:

the actuating means comprises primary and secondary hydraulic piston means for applying primary and secondary nip loading forces to the corresponding primary and other pivots on the shoe;

and further including first and second valve means for controlling the application of hydraulic fluid to the primary and secondary hydraulic pistons and the corresponding force to the primary and other pivots to control the primary and secondary forces, one as a function of the other.

5. A wide area nip type of wet press for dewatering a traveling paper web in a papermaking machine, comprising, in combination:

a rotatable backing roll having an axis of rotation;

a single piece shoe having a concave face surface for applying nip pressure to the web against the backing roll;

a looped belt and one or more looped felts for traveling with the web through the wide area nip between the concave surface of the shoe and an arcuate portion of the backing roll surface to form a pressure zone therebetween, the belt being disposed to travel over the face surface of the shoe;

two, spaced parallel grooves in, the shoe, said grooves extending longitudinally of the shoe and parallel with the axis of rotation of the backing roll;

two, spaced rods extending parallel with, and opposite to, the grooves and having surface contours corresponding to the grooves to permit relative pivotal movement therebetween;

one of the rods and its corresponding groove are located in a radial plane extending through the roll axis of rotation;

primary and secondary actuating means operatively associated in supporting engagement with a respective one of each of the two rods and their grooves, said primary and secondary actuating means structured and arranged for providing parallel actuation forces;

control means operatively connected to respective ones of the primary and secondary actuating means for separately controlling the application of nip loading force by the primary and secondary actuating means.

6. A wide area nip type of wet press as set forth in claim 5, wherein:

the primary and secondary actuating means comprise primary and secondary hydraulic pistons;

the control means comprises primary and secondary valves connected to corresponding ones of the hydraulic pistons.

7. A method for controlling the pressure profile in a wide area nip type of wet press for dewatering a traveling paper web, the press including a rotatable backing roll, a looped belt, one or more looped felts, and a single piece shoe having a concave face surface for engaging the belt over the traveling paper web to express water from the web into said one or more felts and a support surface, the steps comprising:

pivotally supporting the shoe about two pivot points on the support surface of said shoe, said pivot points being spaced from one another in the machine direction of web travel, with the first of said pivot points in the downstream direction being located along a radial plane through the axis of rotation of the backing roll;

said two pivots respectively comprising primary and secondary parallel grooves extending longitudinally in the shoe support surface, and primary and secondary pivot rods disposed in corresponding ones of the primary and secondary grooves in the shoe for providing pivotal movement of the shoe over the pivot rods;

applying parallel nip loading forces to the shoe through the two pivot points respectively to engage the belt, web and said one or more felts against the backing roll to establish a pressure zone thereagainst;

controlling the nip loading force applied to the pivot which is downstream of the other pivot to thereby vary the nip pressure profile within the pressure zone.

8. A method for controlling the pressure profile in a wide area nip type of wet press as set forth in claim 7, including the further step of:

controlling the nip loading force applied to the upstream pivot as a function of the nip loading force applied to the downstream pivot.

* * * * *